US007253781B2

(12) United States Patent
Furuhi et al.

(10) Patent No.: US 7,253,781 B2
(45) Date of Patent: Aug. 7, 2007

(54) ANTENNA DEVICE RADIO UNIT AND RADAR

(75) Inventors: Tomoshige Furuhi, Sagamihara (JP); Yohei Ishikawa, Yokohama (JP)

(73) Assignee: Murata Manufacturing Co., Ltd., Kyoto-Fu (JP)

( * ) Notice: Subject to any disclaimer, the term of this patent is extended or adjusted under 35 U.S.C. 154(b) by 15 days.

(21) Appl. No.: 10/535,654

(22) PCT Filed: Sep. 22, 2003

(86) PCT No.: PCT/JP03/12050

§ 371 (c)(1),
(2), (4) Date: May 19, 2005

(87) PCT Pub. No.: WO2004/051803

PCT Pub. Date: Jun. 17, 2004

(65) Prior Publication Data

US 2006/0044199 A1 Mar. 2, 2006

(30) Foreign Application Priority Data

Dec. 2, 2002 (JP) ..... 2002-350103
Aug. 11, 2003 (JP) ..... 2003-291715

(51) Int. Cl.
*H01Q 19/06* (2006.01)

(52) U.S. Cl. ..... 343/753; 343/754; 343/854

(58) Field of Classification Search ..... 343/700 MS, 343/753, 747, 701, 754, 806, 854
See application file for complete search history.

(56) References Cited

U.S. PATENT DOCUMENTS 3,971,022 A * 7/1976 Lenz ..... 343/754
4,381,566 A * 4/1983 Kane ..... 455/193.3
4,387,378 A * 6/1983 Henderson ..... 342/374

(Continued)

FOREIGN PATENT DOCUMENTS

GB 2 250 865 A 6/1992

(Continued)

OTHER PUBLICATIONS

A copy of the International Search Report and its English Language Translation issued for the parent PCT application, no date available.

*Primary Examiner*—Tho Phan
*Assistant Examiner*—Chuc Tran
(74) *Attorney, Agent, or Firm*—Dickstein, Shapiro, LLP.

(57) ABSTRACT

A resonance element array 200 is disposed between a primary radiator 1 and a lens 3. In the resonance element array 200, resonance elements of linear conductors and variable reactance circuits are arranged on a dielectric substrate. A control voltage is applied to a fixed variable reactance circuit by a control portion so that a fixed resonance element is excited by an electromagnetic wave from the primary radiator 1 and the direction of optical path to be collimated by the lens 3 is electronically changed. Thus, an antenna device, in which a beam scanning is speeded, power consumption for the beam scanning is reduced, operation noise in the beam scanning is eliminated, the reliability is increased, and, when required, the beam direction can be directed to any direction, can be obtained. Furthermore, when necessary, the beam radiation pattern can be changed.

12 Claims, 9 Drawing Sheets

U.S. PATENT DOCUMENTS 6,133,887 A * 10/2000 Tanizaki et al. ..... 343/754
6,188,360 B1 * 2/2001 Kato et al. ..... 343/700 MS

FOREIGN PATENT DOCUMENTS

| | | |
|---|---|---|
| JP | 01-311604 | 12/1989 |
| JP | 06-334432 | 12/1994 |
| JP | 11-127001 | 5/1999 |
| JP | 11-220302 | 8/1999 |
| JP | 2000-068729 | 3/2000 |
| JP | 2001-244720 | 9/2001 |
| JP | 2002-100906 | 4/2002 |
| JP | 2002-261533 | 9/2002 |
| JP | 2002-299952 | 10/2002 |

* cited by examiner

ANTENNA DEVICE RADIO UNIT AND RADAR

TECHNICAL FIELD

The present invention relates to an antenna device in which the directivity can be electronically controlled, and to a radio device and a radar having the antenna device.

BACKGROUND ART

Up to now, for example, an antenna device for a milliwave radar detecting a target by using an electromagnetic wave in the milliwave band is disclosed in Patent Document 1 (Japanese Unexamined Patent Application Publication No. 11-127001). In the antenna device shown in this Patent Document 1, a plurality of primary radiators is time-division switched by using dielectric lines and dielectric line switches, and transmission-reception wave beams are scanned such that the position of effective primary radiators is moved in the focus plane of a dielectric lens.

The antenna device shown in Patent Document 1 has the advantage of having a relatively simple structure and performing beam scanning by simple actions. However, in the antenna device shown in Patent Document 1, since beam scanning is performed by mechanical displacement of the position of the primary radiators, there are problems in that it is difficult to increase the speed of beam scanning beyond a certain level, that power consumption needed for the beam scanning is relatively large, and that operation noise is caused when beam scanning is performed. In addition, since the position of the primary radiators is mechanically displaced, it can be assumed that the life is limited by the wear of sliding portions and the reliability is low when compared with other electronic components.

Furthermore, since the positional displacement of the plurality of primary radiators always has the same pattern, it is impossible to direct the beam in a desired direction and randomly scan beam directions even if required.

Furthermore, since only the relative position of the primary radiators to the lens is displaced, it is impossible to change the radiation pattern of beams.

It is an object of the present invention to provide an antenna device in which the above-described problems are solved, the beam scanning is speeded, power consumption for the beam scanning is reduced, operation noise in the beam scanning is eliminated, the reliability is improved, and, when required, the beam direction can be directed to any direction.

Furthermore, it is another object of the present invention to provide an antenna device in which the above problems are solved and, when required, the radiation pattern of beams can be changed.

DISCLOSURE OF INVENTION

An antenna device of the present invention comprises a resonance element array having a plurality of resonance elements arranged therein, and having a circuit connected to each of the resonance elements for controlling a resonance frequency of the resonance elements; a primary radiator for radiating an electromagnetic wave for excitation to the resonance element array or for receiving an electromagnetic wave radiated from the resonance elements; and collimating means of a lens or reflector disposed such that the position of the resonance element array is a focus plane literally or any position regarded substantially as the focus plane.

Another antenna device of the present invention comprises a resonance element array having a plurality of resonance elements resonating at a fixed (predetermined) frequency arranged therein, and having variable reactance circuits connected to the resonance elements, respectively, each reactance of which is changed by an applied voltage; a control portion for controlling a voltage to be applied to the variable reactance circuits; a primary radiator for radiating an electromagnetic wave for excitation to the resonance element array or for receiving an electromagnetic wave radiated from the resonance elements; and collimating means of a lens or reflector disposed such that the position of the resonance element array is a focus plane literally or any position regarded substantially as the focus plane.

In this way, the directivity of an antenna can be electronically controlled with high freedom as an arbitrary or desired resonance element out of a plurality of resonance elements existing substantially on the focus plane of collimating means of a lens or reflector is excited. Furthermore, when required, a radiation pattern of beams can be changed as some resonance elements out of a plurality of resonance elements are simultaneously excited.

Furthermore, in an antenna device of the present invention, by controlling an applied voltage to the variable reactance circuits, the control portion makes resonance elements at fixed positions or in the vicinity of the fixed positions operate as a wave director out of the plurality of resonance elements and changes the resonance elements at the fixed positions to resonance elements at other positions.

In this way, in the plurality of resonance elements of a resonance element array, the resonance frequency of fixed resonance elements is controlled by controlling an applied voltage to the variable reactance circuits connected thereto. Out of the plurality of resonance elements, the resonance elements resonating to the frequency of an electromagnetic wave radiated from the primary radiator operates as a wave director, an electromagnetic wave re-radiated from the resonance elements as a wave director is collimated by the collimating means, and the beam is formed in a direction determined by the positional relation between the resonance elements and the collimating means. Because of the reversibility principle of an antenna, when the antenna device operates as a reception antenna, the same thing can be said.

Accordingly, it is possible to electronically control the beam direction by controlling an applied voltage to the variable reactance circuits.

Furthermore, in an antenna device of the present invention, a plurality of primary radiators may be provided so that the radiation position to the resonance element array may be optimized or the position for receiving an electromagnetic wave radiated from the resonance element array may be optimized. Thus, even if the plurality of resonance elements contained in a resonance element array is widely distributed, resonance elements to be excited can be excited by using a primary radiator situated close to the resonance elements. Furthermore, an electromagnetic wave radiated from fixed resonance elements can be received by the primary radiator close to the resonance elements.

Furthermore, in an antenna device of the present invention, the primary radiator may include an opening hollow resonator and an excitation source for exciting the opening hollow resonator. Thus, the spatial coupling between each resonance element of a resonance element array and an excitation source is easily performed such that only the resonance element array is disposed at the opening portion of the hollow resonator.

Furthermore, in an antenna device of the present invention, the plurality of resonance elements may include linear conductors extending substantially perpendicular to the arrangement direction and parallel to each other. Thus, the resonance element array can be easily constituted on a dielectric substrate.

Furthermore, in an antenna device of the present invention, the plurality of resonance elements may include linear conductors extending substantially 45 degrees tilted to the arrangement direction and parallel to each other. Thus, when an electromagnetic wave transmitted by another antenna device constituted in the same way is received from the direction of the front, since the plane of polarization is perpendicular to the plane of polarization of the own antenna device, the affect of crossing polarized waves can be reduced.

Furthermore, in an antenna device of the present invention, a variable capacitance diode changing the load reactance to the resonance element may be included in the variable reactance circuit, and the control portion applies a reverse bias voltage to the variable capacitance diode.

Furthermore, in an antenna device of the present invention, a switching element for switching the load reactance to the resonance element may be included in the variable reactance circuit, and the control portion applies a control voltage to the switching element.

Furthermore, in an antenna device of the present invention, an MEMS element where the distance between electrodes is changed by a control voltage may be included in the variable reactance circuit, and the control portion applies a control voltage to the MEMS element.

Furthermore, in an antenna device of the present invention, the switching element may be an MEMS element where a switching control between electrodes is performed by a control voltage.

Furthermore, in an antenna device of the present invention, the primary radiator may be an electronically controlled wave director array antenna in which a feed element is disposed in the center and non-feed elements having a reactance loaded therein are disposed around the feed element. Thus, the radiation pattern of an electromagnetic wave formed in the direction of a resonance element array becomes controllable.

Furthermore, a radio device of the present invention may include one of the above antenna devices.

Moreover, a radar of the present invention may include one of the above antenna devices.

As described above, according to the present invention, the directivity of an antenna can be electronically controlled with high freedom as an arbitrary or desired resonance element out of a plurality of resonance elements existing substantially on the focus plane of collimating means of a lens or reflector is excited. Furthermore, when required, a radiation pattern of beams can be changed as some desired resonance elements out of a plurality of resonance elements are simultaneously excited.

Furthermore, according to the present invention, by controlling an applied voltage to the variable reactance circuits, a resonance elements at a fixed positions operating as a wave director out of the plurality of resonance elements is replaced with another resonance elements at another positions, the direction of a beam can be electronically controlled and, as required, the beam can be directed to a desired direction and the beam direction can be randomly scanned.

Furthermore, according to the present invention, since a plurality of primary radiators is provided so that the radiation position to the resonance element array may be optimized or the position for receiving an electromagnetic wave radiated from the resonance element array may be optimized, even if the plurality of resonance elements in the resonance element array is widely distributed, resonance elements can be excited by using a primary resonator close to the resonance elements to be excited. Furthermore, since an electromagnetic wave radiated from fixed resonance elements can be received by a primary radiator close to the fixed resonance elements, uniform sensitivities can be realized over a wide range.

Furthermore, according to the present invention, since the primary radiator is constituted by an opening hollow resonator and an excitation source for exciting the opening hollow resonator, the spatial coupling between each resonance element of the resonance element array and the excitation source becomes easy such that only the resonance element array is disposed at the opening portion of the hollow resonator.

Furthermore, according to the present invention, since the plurality of resonance elements includes linear conductors extending substantially perpendicular to their arrangement direction and parallel to each other, the resonance element array can be easily constituted on a dielectric substrate.

Furthermore, according to the present invention, since the plurality of resonance elements includes linear conductors extending substantially 45 degrees tilted to their arrangement direction and parallel to each other, when a radio wave transmitted from another antenna device of the same structure from the direction of the front, its plane of polarization is at a right angle to the plane of polarization of the own antenna device and the affect of the crossing planes of polarization can be reduced.

Furthermore, according to the present invention, since a variable capacitance diode changing the load reactance to the resonance element is contained in the variable reactance circuit, and the control portion applies a reverse bias voltage to the variable capacitance diode, the resonance frequency of a resonance element can be changed over a relatively wide frequency range and, for example, the frequency bands in use can be easily switched.

Furthermore, according to the present invention, since a switching element for switching the load reactance to the resonance element is contained in the variable reactance circuit, and the control portion applies a control voltage to the switching element, the switching between a resonant or a non-resonant state of the resonance element, or between the state of a wave director or the state of a reflector can be easily performed.

Furthermore, according to the present invention, since an MEMS element where the distance between electrodes is changed by a control voltage is contained in the variable reactance circuit and the control portion applies a control voltage to the MEMS element, an antenna device can be miniaturized, a monolithic variable reactance circuit together with a resonance element array can be realized, and the applications in the area of millimeter waves and submillimeter waves become easier.

Furthermore, according to the present invention, since the switching element is an MEMS element where a switching control between electrodes is performed by a control voltage, an antenna device can be miniaturized, a monolithic variable reactance circuit together with a resonance element array can be realized, and the applications in the area of millimeter waves and submillimeter waves become easier.

Furthermore, according to the present invention, since the primary radiator is an electronically controlled wave director array antenna in which a feed element is disposed in the center and non-feed elements having a reactance loaded therein are disposed around the feed element, the radiation pattern of an electromagnetic wave formed in the direction of a resonance element array becomes controllable and, for example, even if a plurality of resonance elements in a resonance element array is formed in a relatively wide area, the problem in that the sensitivity is degraded in the vicinity at both ends of a scanning area can be solved.

Furthermore, since a radio device of the present invention contains one of the above antenna devices, radio communications can be performed such that an antenna is quickly directed in a desired direction with low power consumption.

Moreover, since a radar of the present invention contains one of the above antenna devices, a target can be detected over a wide range through high-speed beam scanning.

BEST MODE FOR CARRYING OUT THE INVENTION

The structure of an antenna device according of a first embodiment is described with reference to FIGS. 1 to 4.

Figure 1A:
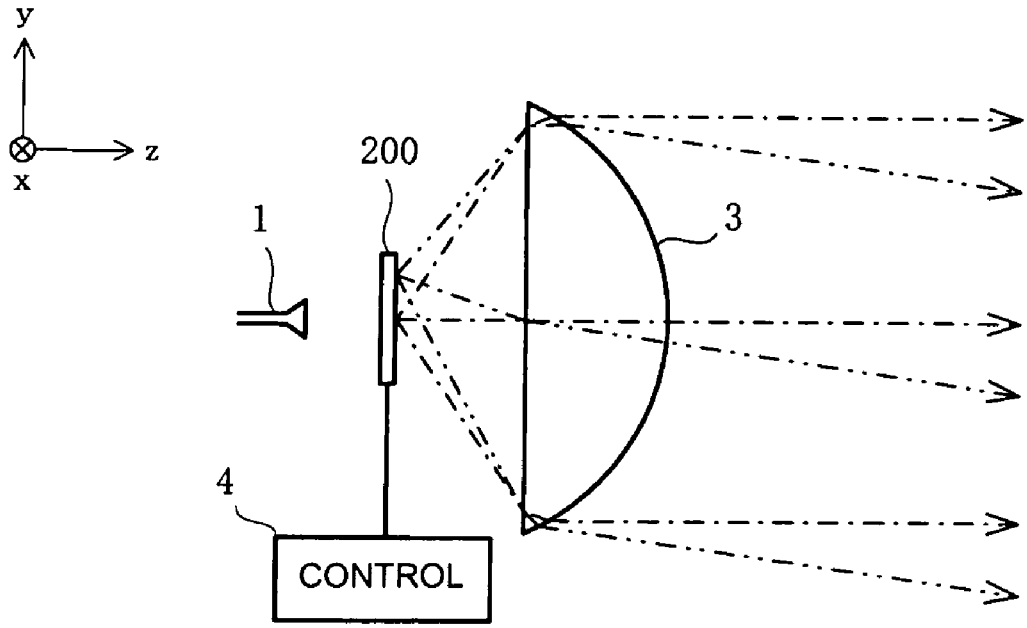
FIGS. 1A and 1B show the whole structure of an antenna device according to a first embodiment.
Figure 1B:
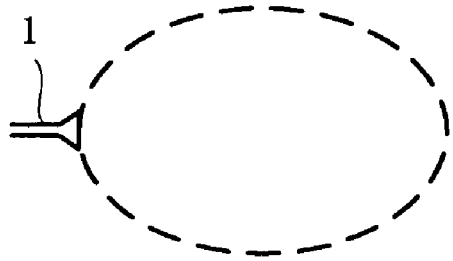

FIG. 1 shows the whole structure of the antenna device. Here, reference numeral 1 represents a primary radiator in a horn antenna and reference numeral 200 represents a resonance element array. In this resonance element array 200, a plurality of resonance elements is provided in a array as will be described later. When this antenna device is used as a transmission antenna, the primary radiator 1 radiates an electromagnetic wave for excitation toward resonance element array 200.

The primary radiator 1 radiates an electromagnetic wave of a linearly polarized wave in the TE10 mode, for example. Part (B) in FIG. 1 shows the radiation pattern of the primary radiator 1. In this way, although the primary radiator 1 has the directivity in the direction of the resonance element array 200, it gives a substantially uniform electric power to the plurality of resonance elements provided in the resonance element array 200.

Out of the plurality of resonance elements provided in the resonance element array 200, a fixed resonance element is resonant with the frequency of the electromagnetic wave radiated from the primary radiator 1 and function as a wave director.

In part (A) of FIG. 1, reference numeral 3 represents a lens made of a dielectric material and having the resonance element array 200 in a focal plane or any position regarded substantially as the focal plane. Since the plurality of resonance elements in the resonance element array 200 is in the focal plane of the lens 3 or in any position regarded substantially as the focal plane, the direction of a beam is determined in accordance with the position of the resonance elements in resonance (that is, which function as a wave director) out of the plurality of resonance elements.

Figure 2A:
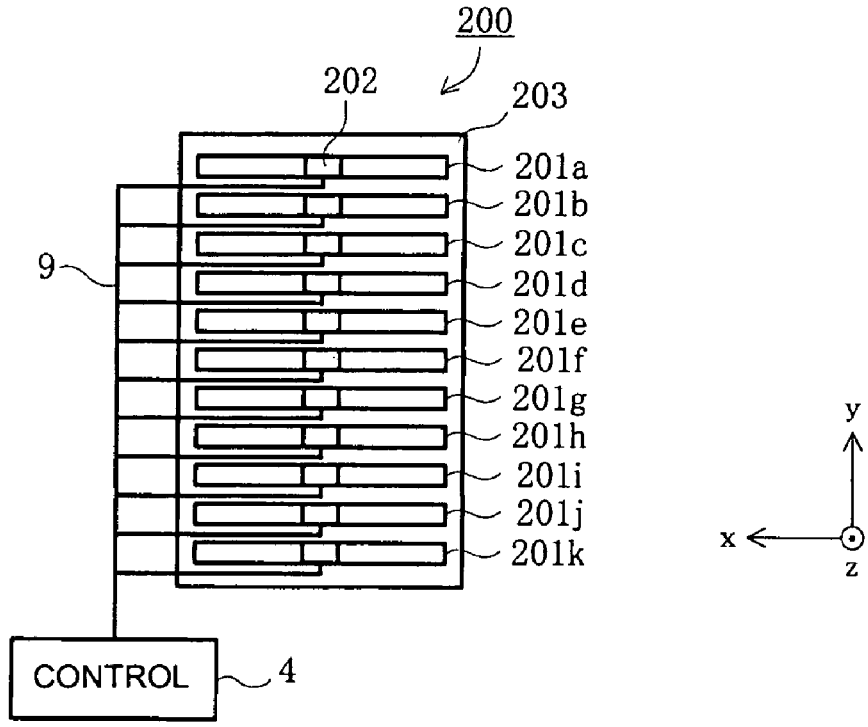
FIGS. 2A and 2B show the structure of a resonance element array, resonance elements, and variable reactance circuits.
Figure 2B:
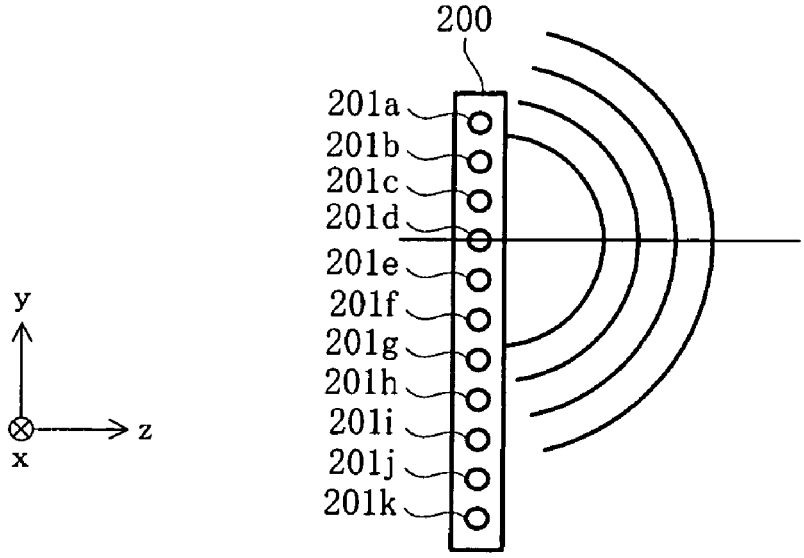

FIG. 2 shows the structure and function of the above resonance element array. Part (A) of FIG. 2 is a top view when the resonance element array 200 is viewed from the side of the lens 3. In the resonance element array 200, the plurality of resonance elements 201, each of which is made of a linear conductor, formed on one surface of a dielectric substrate 203 are arranged so as to be parallel to each other. These linear conductors are disposed so as to be parallel to the direction of a polarized wave in the TE10 mode radiated from the primary radiator.

Furthermore, a variable reactance circuit 202 is provided substantially in the middle of a resonance element 201. A control portion 4 selectively gives a control voltage to each variable reactance circuit 202 of the resonance elements 201*a* to 201*k* through a control signal line 9. For example, when the resonance element 201*f* is made completely resonant or substantially resonant at a frequency in use and the other resonance elements 201*a* to 201*e* and 201*g* to 201*k* are made non-resonant, the resonance element 201*f* functions as a wave director. In the same way, for example, when the resonance element 201*d* is made completely resonant or substantially resonant and the remaining resonance elements 201*a* to 201*c* and 201*e* to 201*k* are made non-resonant, the resonance element 201*d* functions as a wave director.

Because of this, the above resonance elements which are completely resonant or substantially resonant are excited by an electromagnetic wave radiated from the primary radiator and re-radiate an electromagnetic wave. That is, the resonance elements operate just like a primary radiator for the lens.

Moreover, a resonance element may be made to operate as a reflector at a frequency in use such that the resonance frequency of the resonance element which is made non-resonant at the frequency in use is set to be a fixed ratio lower than the frequency in use.

Part (B) of FIG. 2 shows that the resonance element 201*d* operates as a wave director. Thus, an electromagnetic wave is re-radiated from the resonance element 201*d* excited by the primary radiator 1 and is collimated by the lens 3 shown in FIG. 1.

Figure 3:
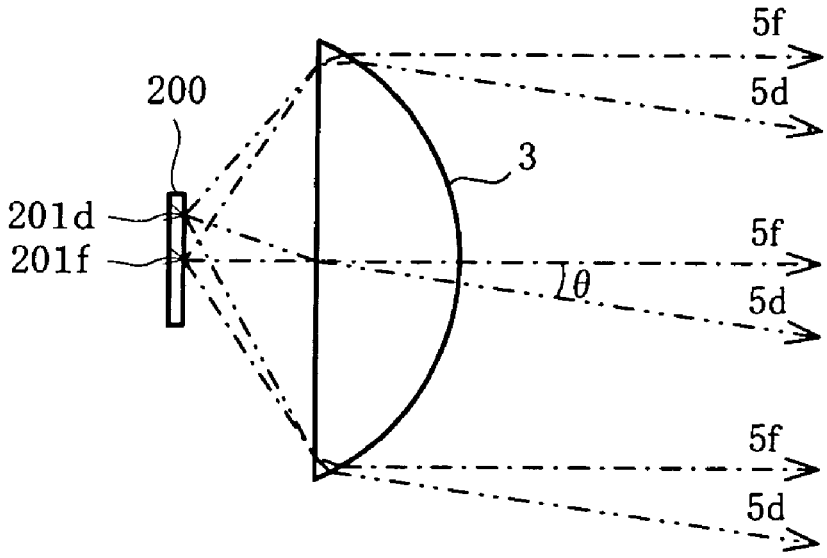
FIG. 3 shows the relation between the position of a resonance element operating as a wave director on a resonance element array and the optical paths collimated by a lens.

FIG. 3 shows examples where the direction of a beam changes in accordance with the position of a resonance element operating as a wave director out of the plurality of resonance elements provided in the resonance element array 200. In these examples, when the resonance element 201*f* is excited by an electromagnetic wave from the primary radiator and operates as a wave director, the beams in the directions shown by optical paths 5*f*, that is, in the direction of the front are formed. Furthermore, when the resonance element 201*d* is excited by an electromagnetic wave from the primary radiator and operates as a wave director, the beams in the direction of optical paths 5*d*, that is, in the direction θ tilted from the direction of the front face are formed.

Since the position of the above resonance elements operating as a wave director can be electronically determined, it becomes able to direct a beam in a desired direction or randomly to scan the direction of a beam when necessary.

Furthermore, the number of resonance elements which are made to operate as a wave director is not limited to be single; out of the arranged plurality of resonance elements, two or more consecutive resonance elements are made to operate as wave directors, and the remaining resonance elements may be made to operate as reflectors. In this way, the width of a radiation pattern of beams can be widened.

Furthermore, when a plurality of resonance elements is made to operate as a wave director, not resonance elements at consecutive positions, but, when necessary, resonance elements positioned at intervals may be made as wave directors. In this way, a radiation pattern of beams which have been collimated may be changed in various ways.

Figure 4:
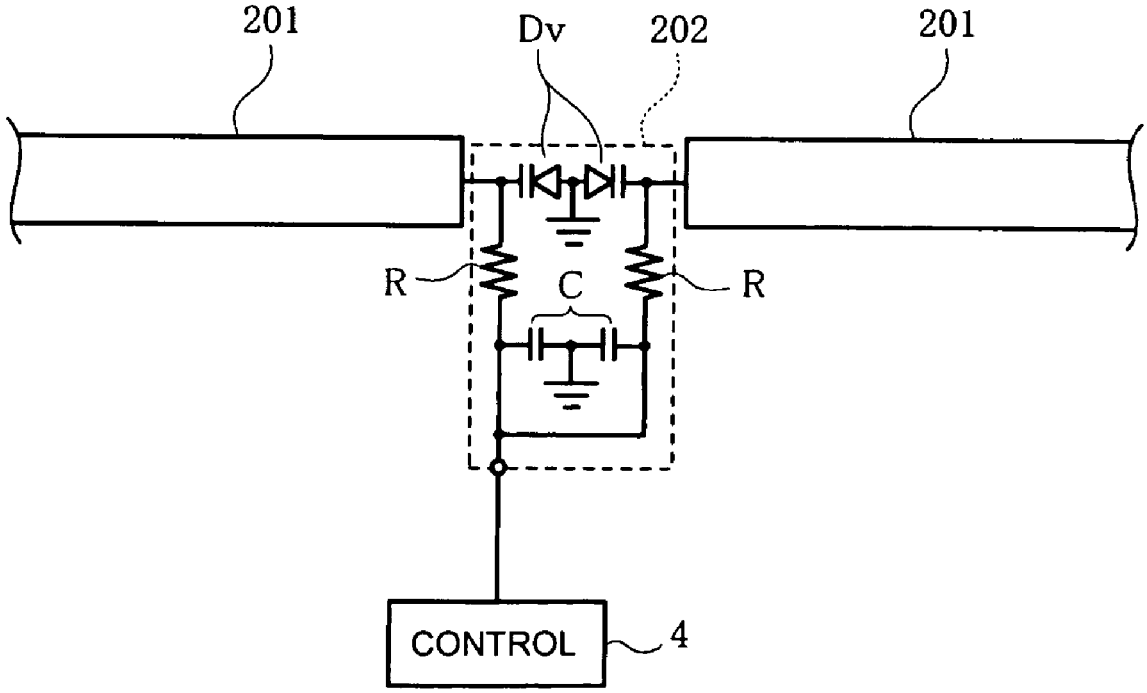
FIG. 4 shows an example of a variable reactance circuit.

FIG. 4 shows a more concrete example of the variable reactance circuit portion shown in part (A) of FIG. 2. In this example, the variable reactance circuit 202 is constituted such that two sets of circuits each of which is made up of a variable diode Dv, a resistor R, and a capacitor C are symmetrically provided, and such that the cathode side of each of the two varactor diodes Dv is connected to the end portions of the resonance element 201, respectively, and the anode side is grounded. Here, the resistor R and the capacitor C constitute a filter which prevents high-frequency signals from leaking to the control portion 4.

Because of such a structure, a capacity loaded antenna in which a varactor diode Dv is loaded between the end portion of the resonance element 201 of a linear conductor and the ground is provided. The capacitance generated between the anode and cathode of the varactor diode Dv is changed by the control voltage applied from the control portion 4. Therefore, the capacitance value of the loaded capacitance of the resonance element 201 changes in accordance with the control voltage applied from the control portion 4. That is, the equivalent electric length of the resonance element 201 changes. For example, the larger the reverse bias voltage to the varactor diode Dv (the deeper the bias), the smaller the capacitance value of the varactor diode Dv, and as a result, the resonance frequency of the resonance element 201 increases. In contrast with this, the smaller the reverse bias voltage to the varactor diode Dv (the shallower the bias), the larger the capacitance value of the varactor diode Dv, and as a result, the resonance frequency of the resonance element 201 decreases.

In this way, the resonance frequency of the resonance element can be controlled by the control voltage give by the control portion 4.

Moreover, in the example shown in FIG. 4, although a varactor diode is used in the variable reactance circuit, an MEMS (microelectromechanical system) element may be used and the drive voltage is applied, such that the electrode-to electrode distance is controlled, and as a result, the reactance may be changed.

As is described above, although a primary radiator having a relatively low gain is used, the position of resonance elements operating as a wave director is electronically determined in a resonance element array, and a high gain beam is formed and the radiation direction can be changed as an electromagnetic wave radiated from the resonance element is collimated by using a lens having a focus plane at the position of a resonance element array. Accordingly, the antenna device can be managed with one system of a high-frequency circuit portion, different from the phased array antenna constituted as a related electronically controlled antenna. That is, since basically only a single primary radiator is used, a low-cost and small antenna device of lower power consumption can be utilized when compared with the phased array antenna.

Moreover, in the example shown in FIG. 1, an ordinary convex lens is used as a dielectric lens, but a lighter and smaller antenna device may be realized by using a Fresnel lens.

Figure 5A:
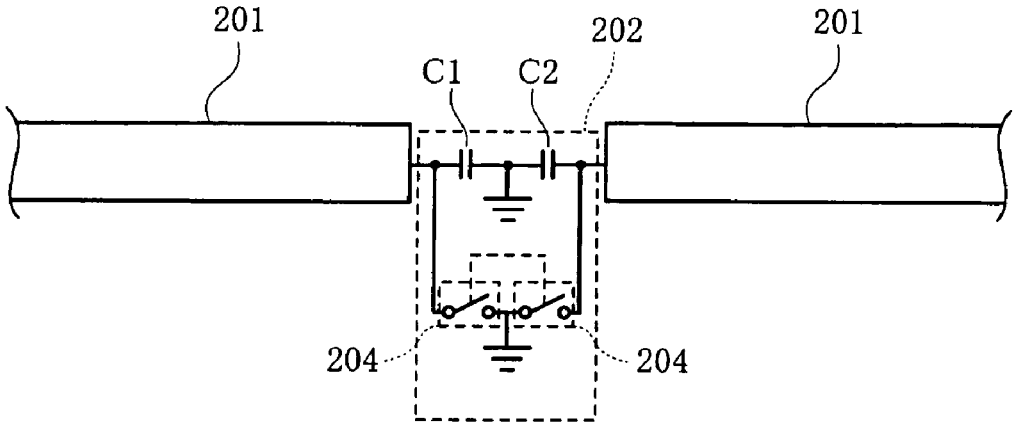
FIGS. 5A and 5B show the structure of a variable reactance circuit of an antenna device according to a second embodiment.
Figure 5B:
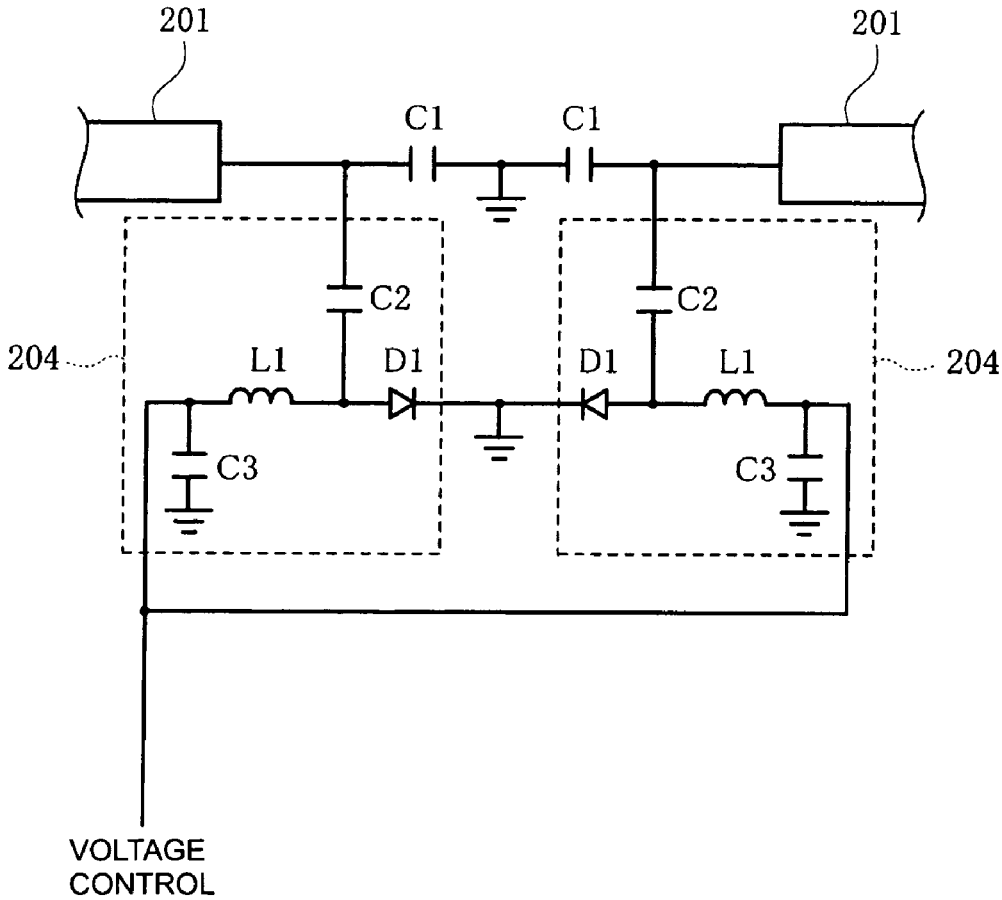

Next, the structure of an antenna device according to a second embodiment is shown in FIG. 5. Different from the antenna device of the first embodiment shown in FIG. 4, in this example, switching circuits 204, switching the load capacitance to the resonance element 201 in two ways by application of a control voltage, are provided in the variable reactance circuit 202. Part (A) of FIG. 5 shows its schematic diagram and part (B) is its concrete circuit diagram.

The variable reactance circuit 202 is composed of capacitances C1 and switching circuits 204, and a diode D1 as a switching element is provided in the switching circuit 204. When no control voltage is applied or a voltage is applied so that the diode D1 may be reverse biased, the diode D1 is turned off and only the capacitor C1 is loaded on the resonance element 201. When a fixed positive voltage is applied as a control voltage, the diode D1 is turned on and the capacitors C1 and C2 in parallel are loaded on the resonance element 201. Accordingly, the load capacitance changes by switching the control voltage and the resonance frequency of the resonance element 201 changes in two ways. Moreover, an inductor L1 and a capacitor C3 constitute a filter circuit, preventing high-frequency signals from leaking to the control portion.

The physical length of the resonance element 201 and the capacitance values of the capacitors C1 and C2 are set so that the resonance element 201 may operate as a wave director or a reflector by switching the above control voltage.

When the reactance circuit 202 is constituted in this way, it is easy to make one fixed resonance element or some fixed resonance elements operate as a wave director or wave directors and make the remaining resonance elements as a reflector by simply switching the control voltage.

In the example shown in FIG. 5, although the diode D1 is used as a switching element, an MEMS (microelectromechanical system) switch element may be used. By applying a drive voltage to the MEMS switch element, a connection between the electrode of the MEMS switch element may be on-off controlled.

Figure 6:
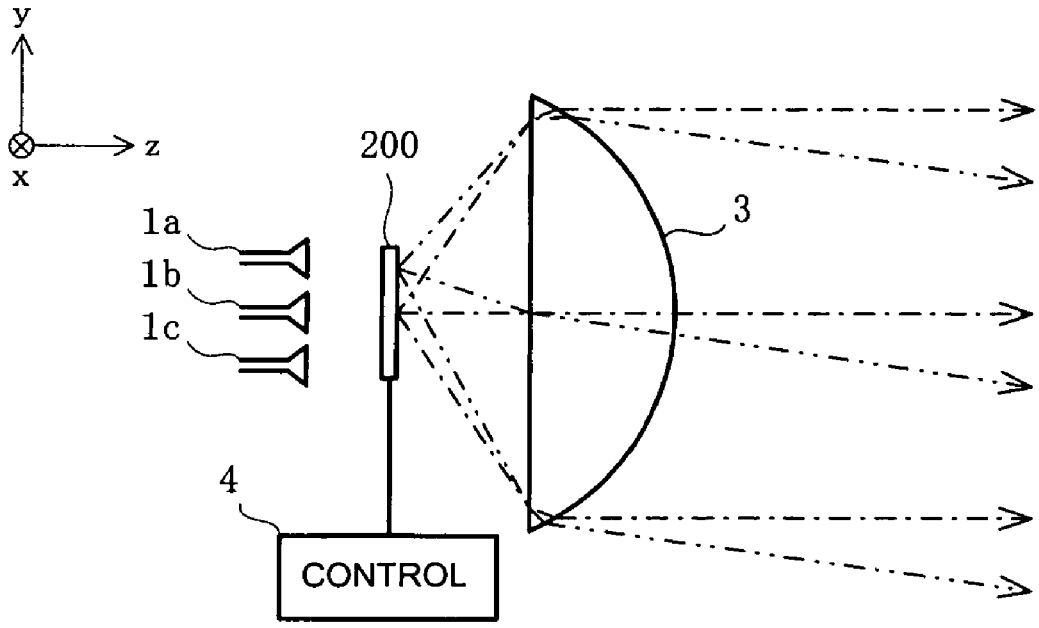
FIG. 6 shows the whole structure of an antenna device according to a third embodiment.

Next, the structure of an antenna device according to a third embodiment is shown in FIG. 6. Different from the antenna device of the first embodiment shown in FIG. 1, in this example, three primary radiators 1*a*, 1*b*, and 1*c* are provided. This is to solve a problem in that, since a plurality of resonance elements in the resonance element array is provided in a relatively large area, when a single primary radiator is used, the power supply to resonance elements away from the central axis of the primary radiator is reduced. That is, out of the plurality of resonance elements provided in the resonance element array 200, the middle primary radiator 1*b* takes charge of the resonance elements provided in the middle portion, substantially one third of the resonance element array 200, the primary radiator 1*a* takes charge of substantially one third in the upper portion in the drawing, and, in the same way, the primary radiator 1*c* takes charge of substantially one third in the lower portion in the drawing. In this way, a more uniform power is radiated to all the resonance elements.

Figure 7:
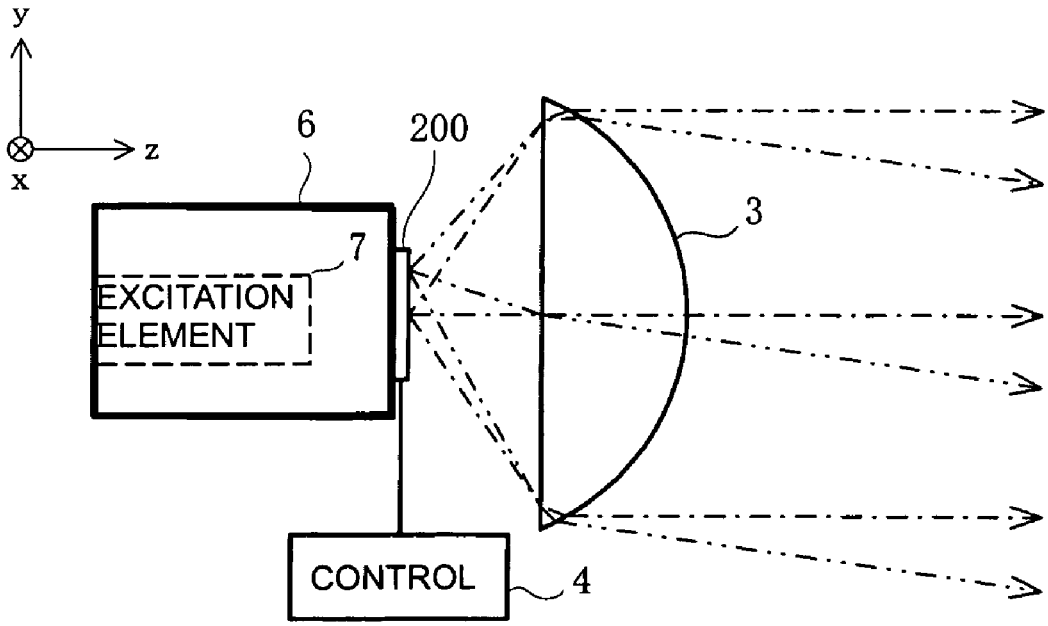
FIG. 7 shows the structure of an antenna device according to a fourth embodiment.

Next, the structure of an antenna device according to a fourth embodiment is shown in FIG. 7. Here, reference numeral 6 represents an opening hollow resonator having an opening in the direction of the lens 3. An excitation element 7 is disposed inside the resonator 6. The same resonance element array 200 as shown in FIG. 2 is disposed in the opening portion of the opening hollow resonator 6. This opening hollow resonator 6 resonates in the TE10 mode and is disposed such that its polarization plane is parallel to the length direction (direction of the extension of linear conductors) of the resonance elements provided in the resonance element array 200. Therefore, an electromagnetic field is given to each resonance element in the resonance element array 200 in the opening surface of the opening hollow resonator 6 by excitation of the excitation element 7. At this time, in the same way as in the cases of the first and second embodiments, the resonance elements in resonance re-radiate an electromagnetic wave as wave directors. Therefore, in the same way as in the cases of the first and second embodiments, the direction of beams which are collimated by the lens 3 is controlled by switching the position of the resonance devices (elements ) operating as a wave director.

Figure 8:
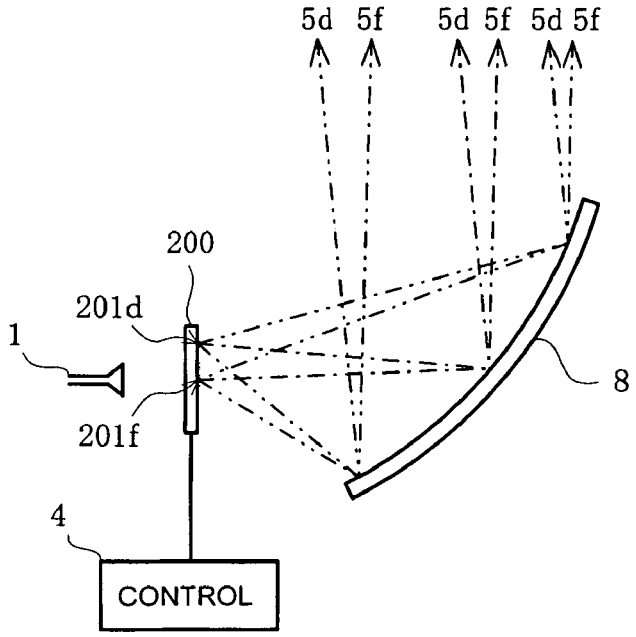
FIG. 8 shows the structure of an antenna device according to a fifth embodiment.

Next, the structure of an antenna device according to a fifth embodiment is shown in FIG. 8. Although the lens 3 is used as a collimating means in the first to fourth embodiments, in the example shown in FIG. 8, a reflector 8 is used as a collimating means. That is, the reflector 8 as an offset parabola reflector is disposed at the position where an electromagnetic wave radiated from a fixed resonance element in the resonance element array 200 is reflected. When the resonance element 201*f* provided in the resonance element array 200 is excited by an electromagnetic wave from the primary radiator and operates as a wave director, a beam is formed in the direction shown by optical paths 5*f*. Furthermore, when the resonance element 201*d* is excited by an electromagnetic wave from the primary radiator and operates as a wave director, another beam is formed in the direction shown by optical paths 5*d*. In this way, the direction of beams can be electronically tilted by controlling a voltage applied by the control portion.

Figure 9:
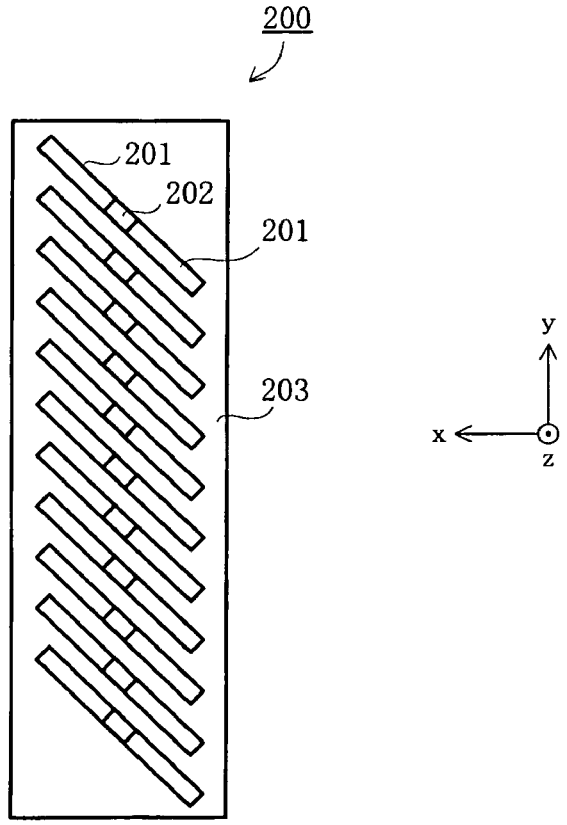
FIG. 9 shows the structure of an antenna device according to a sixth embodiment.

Next, the structure of an antenna device according to a sixth embodiment is shown in FIG. 9. FIG. 9 is a front view of the resonance element array. In this example, a plurality of resonance elements 201 of linear conductors is arranged on the dielectric substrate 203 such that the resonance elements 201 are parallel to each other and are tilted so as to be substantially 45 degrees to the direction of the arrangement. The structure where the reactance circuit 202 is connected to each resonance element 201 is the same as what is shown in FIG. 2.

In this way, an electromagnetic wave of a linearly polarized wave whose plane of polarization is tilted substantially 45 degrees to the horizontal plane is transmitted as the plurality of resonance elements 201 is arranged so as to be substantially 45 degrees tilted to the arrangement direction of the plurality of resonance elements 201. Therefore, when an antenna device receives transmission radio waves in the direction of the front from the millimeter wave radar using an antenna device of the same structure, their plane of polarization and the plane of polarization of the antenna device cross each other at right angles. Therefore, when the antenna device of this structure is applied to millimeter wave radars, the problem of the mutual interference can be reduced.

Figure 10:
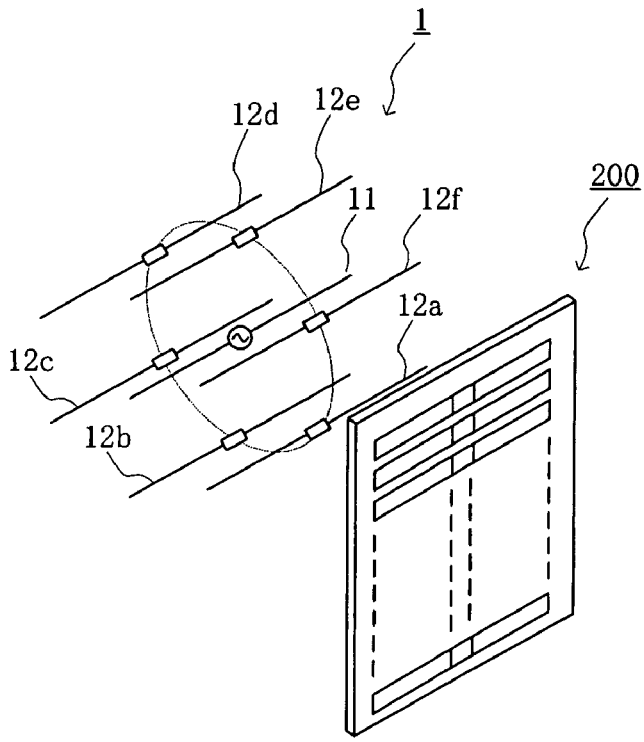
FIG. 10 shows the structure of an antenna device according to a seventh embodiment.

Next, the structure of the main portion of an antenna device according to a seventh embodiment is shown in FIG. 10. In FIG. 10, reference numeral 200 represents a resonance element array and the structure is the same as shown in FIG. 2. Reference numeral 1 represents a primary radiator of an electronically controlled wave-director array antenna. That is, a feed element 11 is contained in the center and a plurality of non-feed elements 12*a* to 12*f* where a reactance is loaded is disposed around the feed element. The non-feed elements 12*a* to 12*f* are resonance elements where a variable reactance circuit is contained in the middle portion, and an antenna in which the reactance of the variable reactance circuit is loaded is constituted. The structure of the variable reactance circuit is the same as those shown in FIGS. 4 and 5. Accordingly, the equivalent electric length changes in accordance with the reactance value and each of the resonance elements is selectively operated as a wave director or reflector.

The feed element 11 operated as a radiator and the radiation pattern variously changes depending on the feed element 11 and the non-feed elements 12*a* to 12*f*. Here, the radiation pattern in the direction of the resonance element array 200 is changed. For example, a control voltage to the variable reactance circuit of the non-feed elements 12*a* to 12*f* is controlled so that the center of the radiation pattern may be directed to the resonance elements which is made to operate as a wave director for the resonance element array 200.

Thus, even if the plurality of resonance elements provided in the resonance element array is widely distributed, an electric power can be uniformly supplied to every resonance element for the resonance element array. Also, an electromagnetic wave radiated from a fixed resonance elements can be received by the primary radiator at a uniform sensitivity.

Moreover, in each embodiment shown in the above, a variable reactance circuit in which the reactance is changed by application of a voltage is provided in order to control the resonance frequency of a fixed resonance elements, but any other control circuit may be provided so that the equivalent electric length of resonance elements may be changed by controlling any other element other than the applied voltage.

Next, the structure of an antenna device according to an eight embodiment is described with reference to FIGS. 11 and 12.

Figure 11:
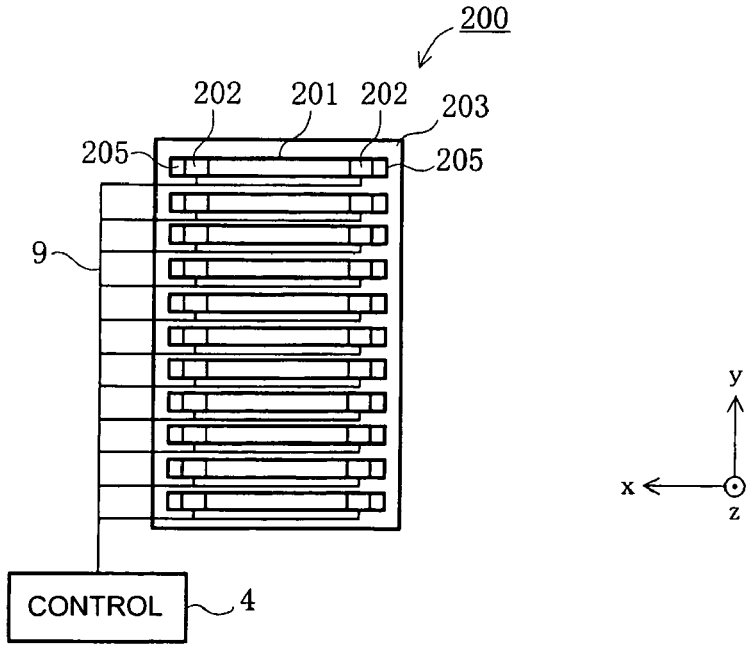
FIG. 11 shows the structure of an antenna device according to an eighth embodiment.

In the example shown in FIG. 2, a plurality of resonance elements 201 is formed on a dielectric substrate 203 and a variable reactance circuit 202 is provided substantially in the middle of each resonance element 201, but in the example shown in FIG. 11, each variable resonance circuits 202 is provided at each end of each resonance element 201 and in addition, each auxiliary elements 205 is formed each of the outside of each circuits 202. The other structure is the same as that shown in FIG. 2. The control portion 4 selectively gives a control voltage to the plurality of variable reactance circuits 202 through the control signal line 9. For example, when one resonance element 201 is made completely resonant or substantially resonant at a frequency in use and the other resonance elements are made non-resonant, the resonant or substantially resonant resonance elements operate as a wave director.

Figure 12:
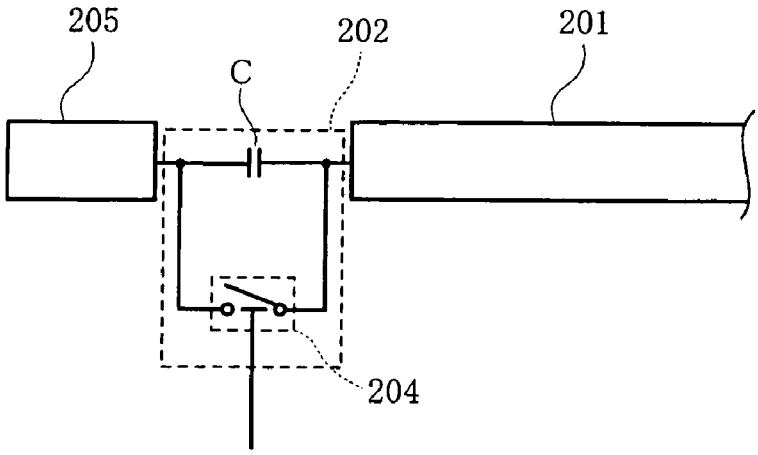
FIG. 12 shows the structure of the portion of a variable reactance circuit of the antenna device.

FIG. 12 shows a concrete example for the variable reactance circuit 202 shown in FIG. 11. In this example, the variable reactance circuit 202 is composed of a capacitor C and a switching circuit 204 connected in parallel to the capacitor C. The switching circuit 204 is an MEMS element which is turned on and off by application of a control voltage through the control signal line 9.

When the switching circuit 204 is in the off state, the auxiliary element 205 is connected to the end portion of the resonance element 201 through the capacitor C. Furthermore, when the switching circuit 204 is in the on state, the auxiliary element 205 of a fixed electric length is connected to the end portion of the resonance element 201. In this way, the equivalent electric length of the resonance element is switched. Thus, since the auxiliary elements 205 are connected to both ends of the resonance element 201, the symmetry of the resonance element can be maintained.

Figure 13:
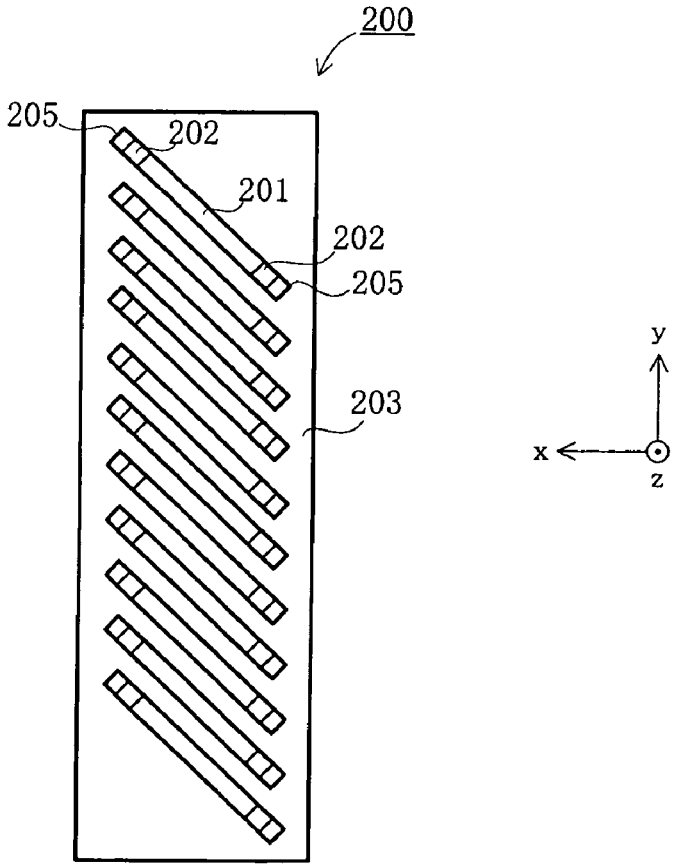
FIG. 13 shows the structure of an antenna device according to a ninth embodiment.

FIG. 13 is a front view of a resonance element array 200 constituting the main portion of an antenna device according to a ninth embodiment. In the resonance element array 200, each element includes a resonance element 201, two reactance circuits 202 and two auxiliary elements 205 is arranged on the dielectric substrate 203 so as to be parallel to each other and substantially 45 degrees tilted to the arrangement direction of the antenna elements.

Thus, in the same way as in the case of the antenna device shown in FIG. 9, an electromagnetic wave of a linearly polarized wave in which the plane of polarization is substantially 45 degrees tilted to the horizontal plane can be transmitted and received.

Figure 14:
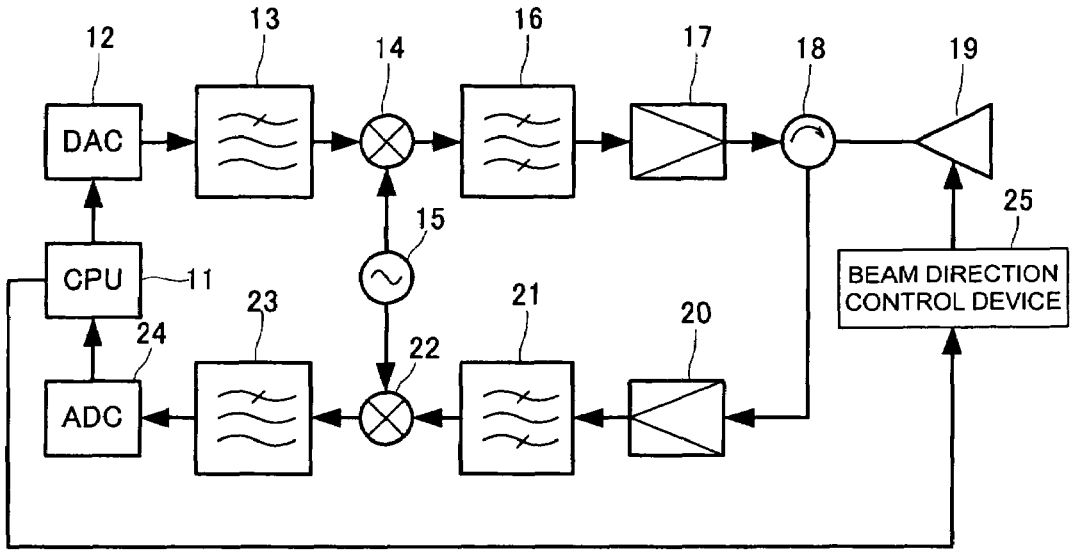
FIG. 14 shows the structure of a radio device according to a tenth embodiment.

Next, a radio device according to a tenth embodiment is described with reference to FIG. 14. In FIG. 14, A CPU 11 outputs a transmission signal of a digital code sequence. A DA converter 12 converts the signal into an analog signal. A low-pass filter 13 makes unnecessary high-frequency signals attenuated. A mixer 14 mixes an oscillation signal of an RF oscillator 15 and an output signal from the low-pass filter 13. A bandpass filter 16 makes output signals of the mixer 14 pass only in a fixed frequency range, a power amplifier 17 power amplifies the signals and makes the signals radio-transmitted from an antenna 19 through a circulator 18. A reception signal received at the antenna 19 is input to a low-noise amplifier 20 through the circulator 18. The low-noise amplifier 20 amplifiers the reception signal, and a bandpass filter 21 makes unnecessary signals out of the output signals from the low-noise amplifier 20 attenuated. A mixer 22 mixes an oscillation signal of the RF oscillator 15 and the output signals from the bandpass filter 21. A low-pass filter 23 makes unnecessary high-frequency components out of the output signals from the mixer 22 attenuated. An AD converter 24 converts the signals into digital data sequences. The CPU 11 processes the data sequences in order. Furthermore, the CPU 11 controls a beam direction control device 25 such that the directivity direction of the antenna 19 (center of the directivity pattern) is directed to a fixed direction. The beam direction control device 25 corresponds to the control portion 4 in each embodiment which has been described and the directivity of the antenna is controlled by making fixed resonance elements of the resonance element array 200 excited or by controlling the reactance of fixed reactance circuits.

Next, a radar according to an eleventh embodiment is described with reference to FIG. 15.

Figure 15:
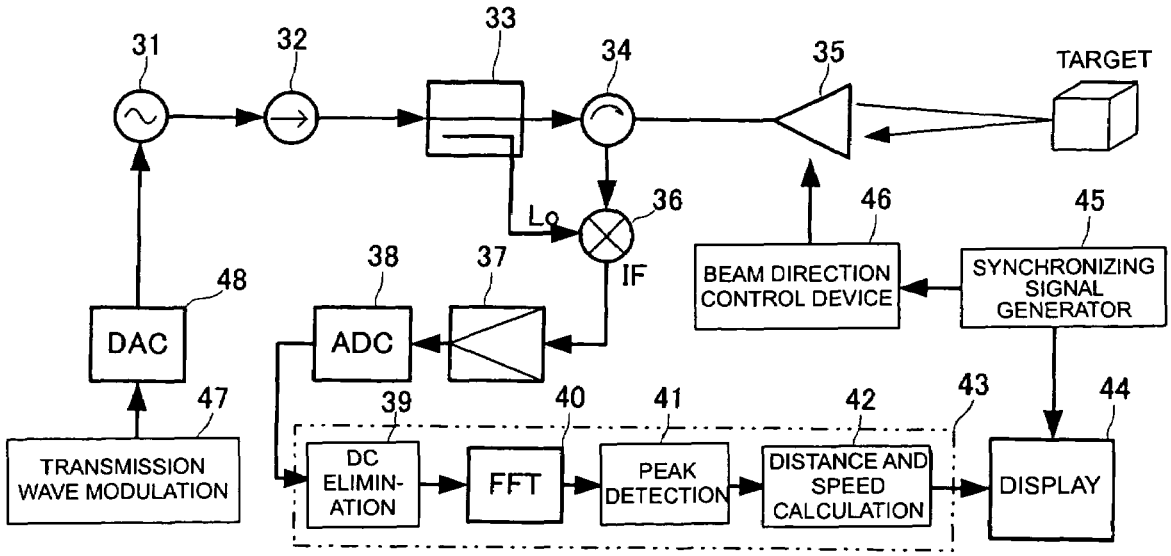
FIG. 15 shows the structure of a radar according to an eleventh embodiment.

FIG. 15 is a block diagram showing the whole structure of a radar. Here, a VCO 31 changes an oscillation frequency in accordance with a control voltage output from a DA converter 48. A transmission wave modulation portion 47 outputs digital data of a modulation signal to the DA converter 48 in order. Thus, the oscillation frequency from the VCO 31 is FM-modulated into a triangular wave signal in succession.

An isolator 32 transmits the oscillation signal from the VCO 31 to the side of a coupler 33 and prevents a reflection signal from entering the VCO 31. The coupler 33 transmits the signal coming through the isolator 32 to the side of a circulator 34 and gives a part of a fixed distribution ratio of the transmission signal as a local signal Lo to a mixer 36. The circulator 34 transmits the transmission signal to the side of an antenna 35 and gives a reception signal from the antenna 35. The antenna 35 transmits the transmission signal where a continuous wave from the VCO 31 is FM-modulated into a triangular wave signal, and receives a reflection signal from a target. Furthermore, the direction of the beam is periodically changed over the range of detection angles.

The mixer 36 mixes the local signal Lo from the coupler 33 and the reception signal from the circulator 34 to output an intermediate-frequency signal. An IF amplifier circuit 37 amplifies the intermediate-frequency signal at a fixed amplification degree in accordance with the distance. An AD converter 38 converts the voltage signal into a sampling data sequence. In a DC elimination portion 39, out of sampling data sequences obtained by the AD converter 38, an average value of the sampling data sequence that is obtained during a fixed sampling interval and is an object to be processed at a backstage FFT is deemed to be a DC component, and the DC component is subtracted from each data of the whole sampling intervals.

Regarding the data of the above sampling intervals in which the DC component is removed, an FET operation portion 40 analyzes their frequency components. A peak detection portion 41 detects maximum positions regarding frequency components having levels beyond a predetermined threshold value.

A distance and speed calculation portion 42 calculates the distance from the antenna to a target and the relative speed based on the frequency of a beat signal (upbeat signal) in a modulation interval where the frequency of a transmission signal gradually increases and the frequency of a beat signal (downbeat signal) in a modulation interval where the frequency of a transmission signal gradually decreases, and outputs these to a display 44.

The DC elimination portion 39, the FET operation portion 40, the peak detection portion 41, and the distance and speed calculation portion 42 are assembled into an operation element 43 such as a DSP (digital signal processing circuit), etc.

A beam direction control device 46 controls the directivity direction of the antenna 35. This beam direction control device 46 corresponds to the control portion 4 shown in each embodiment, and the directivity of the antenna is controlled by making fixed resonance elements in the resonance element array 200 excited or by controlling the reactance of fixed reactance circuits.

A synchronizing signal generator 45 gives a synchronizing signal to the beam direction control device 46 and the display 44.

The display 44 displays a two-dimensional radar detection image based on an the synchronizing signal and distance from the synchronizing signal generator and the output signal from the speed calculation portion 42.

INDUSTRIAL APPLICABILITY

As described above, in an antenna device according to the present invention, the beam scanning is speeded, power consumption for the beam scanning is reduced, operation noise in the beam scanning is eliminated and the reliability can be increased. Furthermore, when required, the beam direction can be directed in any direction and the beam radiation pattern can be changed. Accordingly, an antenna device of the present invention is valuable for radio devices and mobile radars.

The invention claimed is:

1. An antenna device comprising:

a resonance element array having a plurality of resonance elements resonating at a fixed frequency arranged therein, and having variable reactance circuits connected to the resonance elements, respectively, whose reactance is changed by an applied voltage;

a voltage control portion that applies the voltage to the variable reactance circuits;

a plurality of primary radiators for radiating an electromagnetic wave for excitation to the resonance element array or for receiving an electromagnetic wave radiated from the resonance element array, each of the plurality of primary radiators being allocated to a respective portion of the plurality of resonance elements; and a lens or reflector collimator disposed such that the position of the resonance element array is substantially a focus plane.

2. An antenna device as claimed in claim 1, wherein the voltage control portion is operative to control the applied voltage to the variable reactance circuits so as to cause at least one of the plurality of resonance elements to operate as a wave director.

3. An antenna device as claimed in claim 1, wherein a variable capacitance diode that changes a load reactance to the resonance element is contained in the variable reactance circuits, and wherein the control applies a reverse bias voltage to the variable capacitance diode.

4. An antenna device as claimed in claim 1, wherein a switching element for switching a load reactance to the resonance element is contained in the variable reactance circuits, and wherein the control applies a control voltage to the switching element.

5. An antenna device as claimed in claim 4, wherein the switching element is an MEMS element.

6. An antenna device as claimed in claim 1, wherein an MEMS element is contained in the variable reactance circuits, and wherein the voltage control portion applies a control voltage to the MEMS element.

7. An antenna device as claimed in claim 1, wherein the plurality of primary radiators are arranged so that a radiation position to the resonance element array is optimized or a position for receiving the electromagnetic wave radiated from the resonance element array is optimized.

8. An antenna device as claimed in claim 1, wherein the plurality of resonance elements comprise linear conductors extending substantially perpendicular to an arrangement direction thereof and parallel to each other.

9. An antenna device as claimed in claim 1, wherein the plurality of resonance elements comprise linear conductors arranged substantially at a 45 degree angle relative to an arrangement direction thereof and parallel to each other.

10. An antenna device comprising:

a resonance element array having a plurality of resonance elements arranged therein, and having a circuit connected to each of the resonance elements for controlling a resonance frequency of the resonance elements;

a plurality of primary radiators for radiating an electromagnetic wave for excitation to the resonance element array or for receiving an electromagnetic wave radiated from the resonance element array, each of the plurality of primary radiators being allocated to a respective portion of the plurality of resonance elements; and a lens or reflector collimator disposed such that the position of the resonance element array is substantially a focus plane, wherein the plurality of primary radiators are arranged so that a radiation position to the resonance element array is optimized or a position for receiving the electromagnetic wave radiated from the resonance element array is optimized.

11. An antenna device comprising:

a resonance element array having a plurality of resonance elements arranged therein, and having a circuit connected to each of the resonance elements for controlling a resonance frequency of the resonance elements;

a plurality of primary radiators for radiating an electromagnetic wave for excitation to the resonance element array or for receiving an electromagnetic wave radiated from the resonance element array, each of the plurality of primary radiators being allocated to a respective portion of the plurality of resonance elements; and a lens or reflector collimator disposed such that the position of the resonance element array is substantially a focus plane, wherein the plurality of resonance elements comprise linear conductors extending substantially perpendicular to an arrangement direction thereof and parallel to each other.

12. An antenna device comprising:

a resonance element array having a plurality of resonance elements arranged therein, and having a circuit connected to each of the resonance elements for controlling a resonance frequency of the resonance elements;

a plurality of primary radiators for radiating an electromagnetic wave for excitation to the resonance element array or for receiving an electromagnetic wave radiated from the resonance element array, each of the plurality of primary radiators being allocated to a respective portion of the plurality of resonance elements; and a lens or reflector collimator disposed such that the position of the resonance element array is substantially a focus plane, wherein the plurality of resonance elements comprise linear conductors arranged substantially at a 45 degree angle relative to an arrangement direction thereof and parallel to each other.

* * * * *